United States Patent [19]

Brantman

[11] Patent Number: 5,067,188

[45] **Date of Patent: * Nov. 26, 1991**

[54] SLIDING TRANSFER DEVICE

[76] Inventor: Robert F. Brantman, 1400 N. Waukegan Rd., Lake Forest, Ill. 60045

[ * ] Notice: The portion of the term of this patent subsequent to Jan. 29, 2008 has been disclaimed.

[21] Appl. No.: 642,416

[22] Filed: Jan. 17, 1991

Related U.S. Application Data

[63] Continuation-in-part of Ser. No. 519,290, May 4, 1990, Pat. No. 4,987,621.

[51] Int. Cl.[5] ..... A61G 7/053; A61G 7/10

[52] U.S. Cl. ..... 5/81 R

[58] Field of Search ..... 5/81 R, 81 B, 81 C, 5/86; 193/35 R; 414/921

[56] References Cited

U.S. PATENT DOCUMENTS

| | | | |
|---|---|---|---|
| 758,493 | 4/1904 | Abbey | 414/541 |
| 1,876,922 | 9/1932 | Hamilton . | |
| 2,565,761 | 8/1951 | Dean | 5/86 |
| 2,691,782 | 10/1954 | West | 5/81 R |
| 3,786,523 | 1/1974 | Sele | 5/86 |
| 3,962,736 | 6/1976 | Fedele | 5/81 R |
| 4,137,581 | 2/1979 | Daly | 5/81 B |
| 4,259,756 | 4/1981 | Pace | 5/81 B |
| 4,644,594 | 2/1987 | Johnson | 5/81 R |
| 4,815,785 | 3/1989 | Goodall et al. | 414/921 |

FOREIGN PATENT DOCUMENTS

| | | | |
|---|---|---|---|
| 722480 | 11/1965 | Canada | 193/35 R |
| 2809526 | 9/1979 | Fed. Rep. of Germany . | |

OTHER PUBLICATIONS

Preston, 1989 Winter Catalog, PC 7087 p. 148.

Fabrication Enterprises Inc., 1988 Catalog, p. 62.

*Primary Examiner*—Alexander Grosz

*Attorney, Agent, or Firm*—Willian Brinks Olds Hofer Gilson & Lione

[57] ABSTRACT

A sliding transfer device comprising a lower support plate and an upper seat. The upper seat is pivotally attached to the lower support plate to slide over the top surface of the plate. A person being transferred from one location to another, such as the edge of a bed to a wheelchair seat, is placed upon the upper seat, and is transferred as the seat slides across the top surface of the lower support plate. The lower support plate may be straight, curved, or S-shaped.

17 Claims, 4 Drawing Sheets

SLIDING TRANSFER DEVICE

CROSS REFERENCE TO RELATED APPLICATION

This application is a continuation in part of application Ser. No. 519,290, filed May 4, 1990 now U.S. Pat. No. 4,987,621.

FIELD OF THE INVENTION

This invention relates to a device for transferring a patient from one location to another. More specifically, the invention relates to a sliding device for transferring a patient between two proximate locations such as a bed and a wheelchair.

BACKGROUND OF THE INVENTION

Those with lower extremity disabilities often have difficulty moving from one location to another. Often times these people are confined to a wheelchair and require assistance to transfer between a bed, tub, or commode to a wheelchair or similar device.

Presently, assistance in transferring patients can be provided by transfer boards, which are generally solid, smooth, rectangular-shaped plywood boards, approximately 8 inches wide and 24 to 30 inches long. To move a patient from a bed to a wheelchair, for example, one end of the rectangular transfer board is placed under the patient sitting on the edge of the bed, and the other end of the board is placed on the wheelchair seat. Generally with the assistance of at least one person, the patient slides across the board from the bed toward the wheelchair. The patient then sits on the corner of the wheelchair seat, and makes a half turn, backwards into the wheelchair, as the transfer board is removed.

This operation usually requires considerable strength and effort by the patient. If the patient lacks the required strength, as in the case of a disabled person or some senior citizens, more than one person may be needed to help slide the patient across the transfer board. But, this becomes a problem when the only assistance available is from someone who also is disabled, or more commonly, a senior citizen.

It therefore is an object of the present invention to greatly reduce the amount of assistance required in transferring a patient or invalid between proximate locations. It is further an object of the present invention to reduce the amount of turning the patient must endure in transferring between these locations. These and other objectives are accomplished by the sliding transfer device described.

SUMMARY OF THE INVENTION

The present invention relates to a substantially rectangular, or curved, sliding transfer device. In one embodiment, the device comprises an upper seat member slidably attached to a lower support plate having a substantially flat top surface. To transfer a patient from a bed to a wheelchair, for example, one end of the lower support plate is placed under the patient at the edge of the bed. The other end is placed on the edge of the wheelchair seat. The upper seat is moved under the patient. The patient sits on the upper seat, and is carried by the seat as it slides across the top surface of the lower support plate toward the edge of the wheelchair seat. At the wheelchair seat, the patient turns backwards into the wheelchair with considerably less difficulty than with presently available boards. The sliding transfer device is then removed from beneath the patient.

In another embodiment, the top surface of the lower support plate is curved or arranged in one, or more arcs. To transfer a patient, one end of the lower support plate and the seat are placed under the patient and on the edge of the bed, and the other end is placed on the edge of the wheelchair seat. In this embodiment, the sliding transfer device is placed between the bed and wheelchair seat so that, as the patient slides across the curvature of the top surface, the patient's back is turned toward the wheelchair back. Thus, in this embodiment, the patient needs to turn only slightly backward into the wheelchair seat, further reducing the difficulty of transferring.

In another embodiment, the top portion of the lower support member is curved at both ends to form an S-shape, and the center portion is either substantially rectangular, or slightly arranged in an arc. The patient is transferred in the same way as already described.

In yet another embodiment, the upper seat member is slidably joined to the lower support plate by a swivel. The swivel enhances transfer of the patient because it allows either the seat or the support plate to pivot freely as the patient is moved on and off of the upper seat. The swivel feature may be used with any of the lower support plate embodiments.

In another embodiment, the upper seat member also contains flexible flaps, which may handles to assist in moving the patient. The flexible flaps assist in placing the seat under the patient, and protect clothing or parts of the patient's body from becoming entangled between the upper seat and the lower support plate. This seat embodiment may be optionally mounted with the swivel embodiment, and either combination may be used with and of the lower support embodiments.

DETAILED DESCRIPTION OF THE DRAWINGS AND PREFERRED EMBODIMENTS

Figure 1:
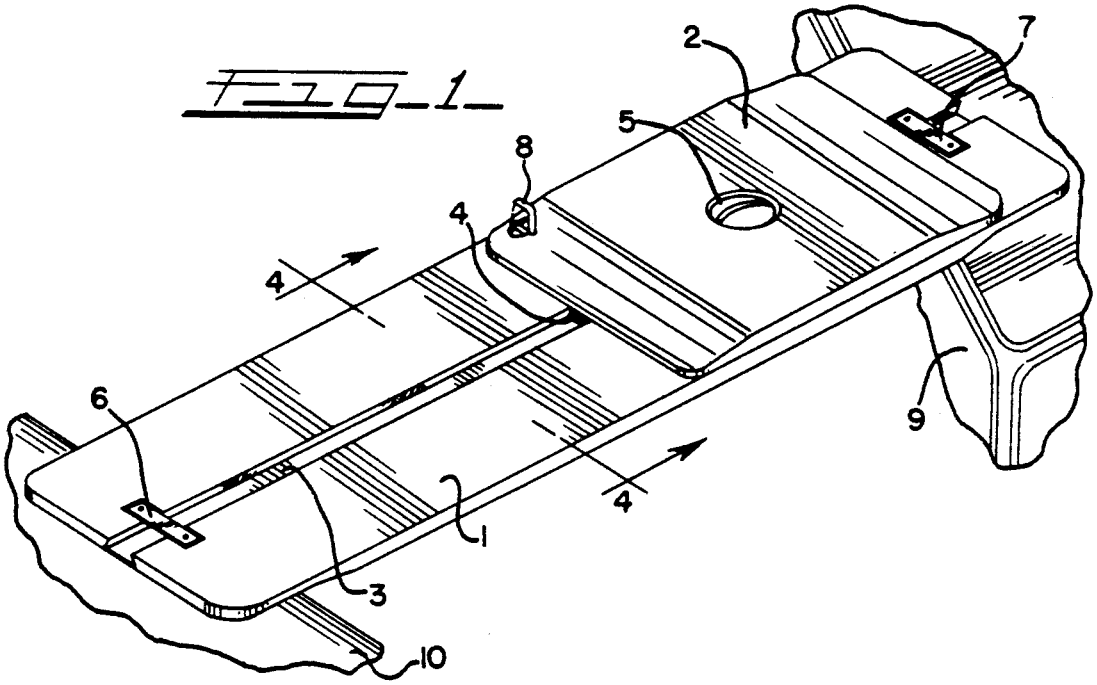
FIG. 1 illustrates a sliding transfer device of the present invention comprising a substantially rectangular lower support plate.
Figure 4:
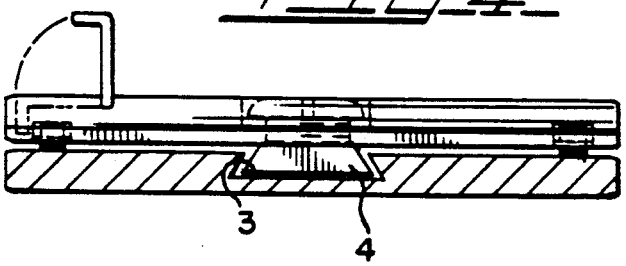
FIG. 4 illustrates a section view of FIG. 1.

FIG. 1 illustrates one embodiment of the sliding transfer device of the present invention. This embodiment comprises a lower support plate 1 having a substantially flat, rectangular top surface, and an upper seat 2. The upper seat is slidably affixed to the lower support member by a track and guide assembly. In this embodiment, track 3 comprises a female recess running the length of the lower support plate. As shown in FIG. 4, a male guide 4 is fixed within the recessed track. The male guide may comprise a continuous wedge shaped guide 4 set within the recessed track 3. An adjustable tension screw 5 may be employed to further assist in attaching upper seat 2 to lower support plate 1, and to control the movement of the seat across the lower support plate. Lock plates 6 and 7 may also be located at either end of lower support plate 1 to keep the upper seat on the recessed track. Locking device 8 enhances patient safety and control over movement of seat 2.

In operation, lower support plate 1 is laid across the edge of a bed 9 and the edge of wheelchair seat 10. To transfer from the bed to the wheelchair, the patient sits on upper seat 2. The patient is carried from the bed to the wheelchair as upper seat 2 slides across the top surface of lower support plate 1. Because of the sliding action of the upper seat, the patient requires much less assistance when transferring from one proximate location to another.

Figure 2:
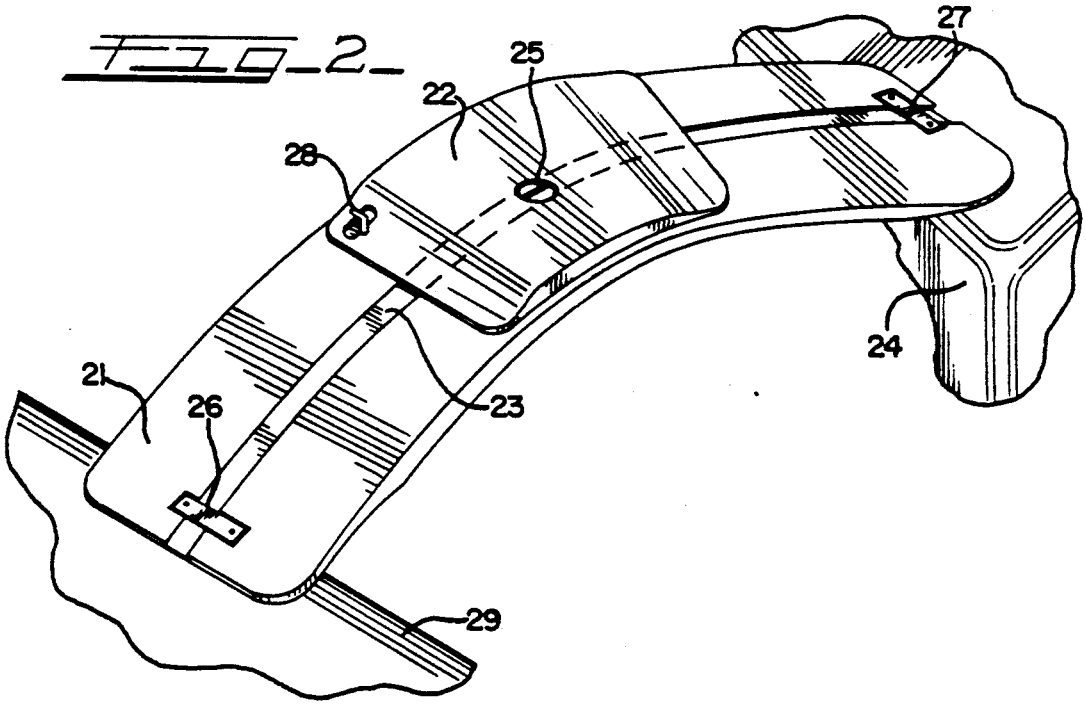
FIG. 2 illustrates a sliding transfer device of the present invention comprising a curved lower support plate.

FIG. 2 illustrates another embodiment of the present invention containing curved lower support plate 21. In this embodiment, curve-shaped upper seat 22 is slidably attached to lower support plate 21 by a guide and track assembly. Track 23 also is curved in accordance with the curvature of lower support plate 21. Adjustable tension screw 25, locking plates 26 and 27, and locking device 28, may also be employed as in the embodiment of FIG. 1.

To transfer a patient from a bed to a wheelchair, one end of the curved lower support plate 21 is placed under the patient at the edge of bed 29, and the other end is placed at the edge of wheelchair seat 24. The patient preferably sits on seat 22 with the patient's back facing the convex portion of the curved lower support plate, and the patient's legs within the convex portion of the lower support plate. The patient is carried from the bed to the wheelchair seat as upper seat 22 slides along the curved path formed by recessed track 23. As seat 22 traverses curved track 23, the patient's back is turned toward wheelchair seat 24. Thus, in this embodiment, the patient also requires much less assistance in turning into the sitting position in the wheelchair.

Figure 7:
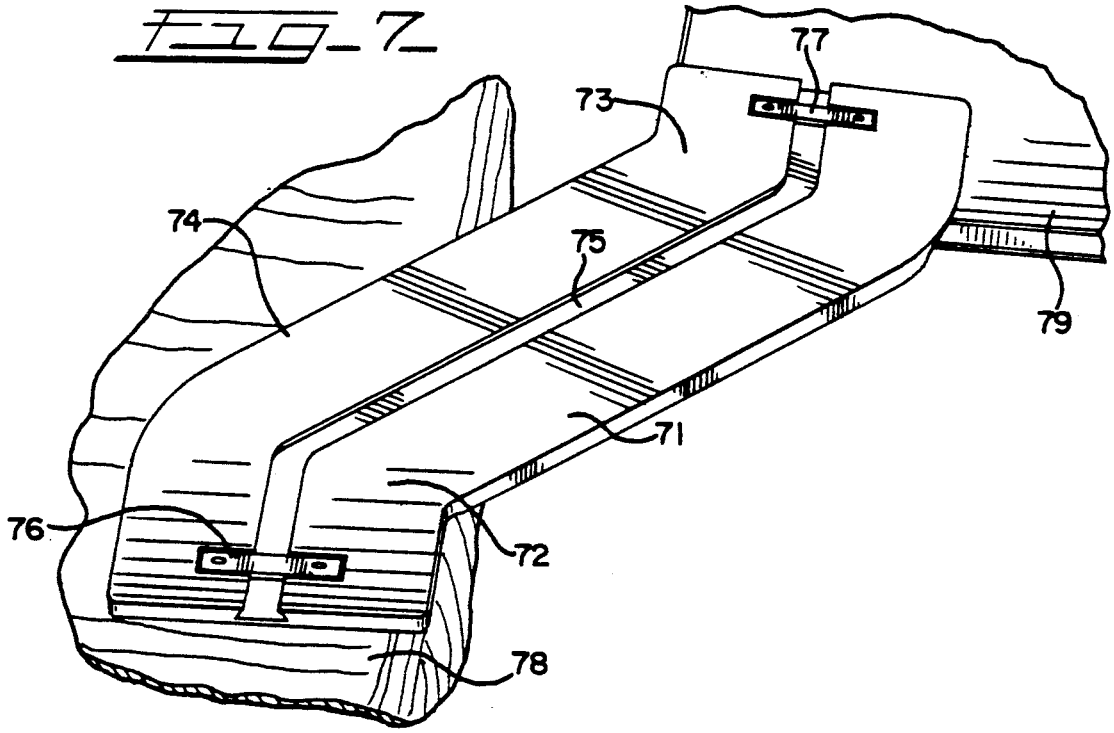
FIG. 7 illustrates a sliding transfer device of the present invention comprising a lower support plate having curves at both ends to form a partial S-shape.
Figure 8:
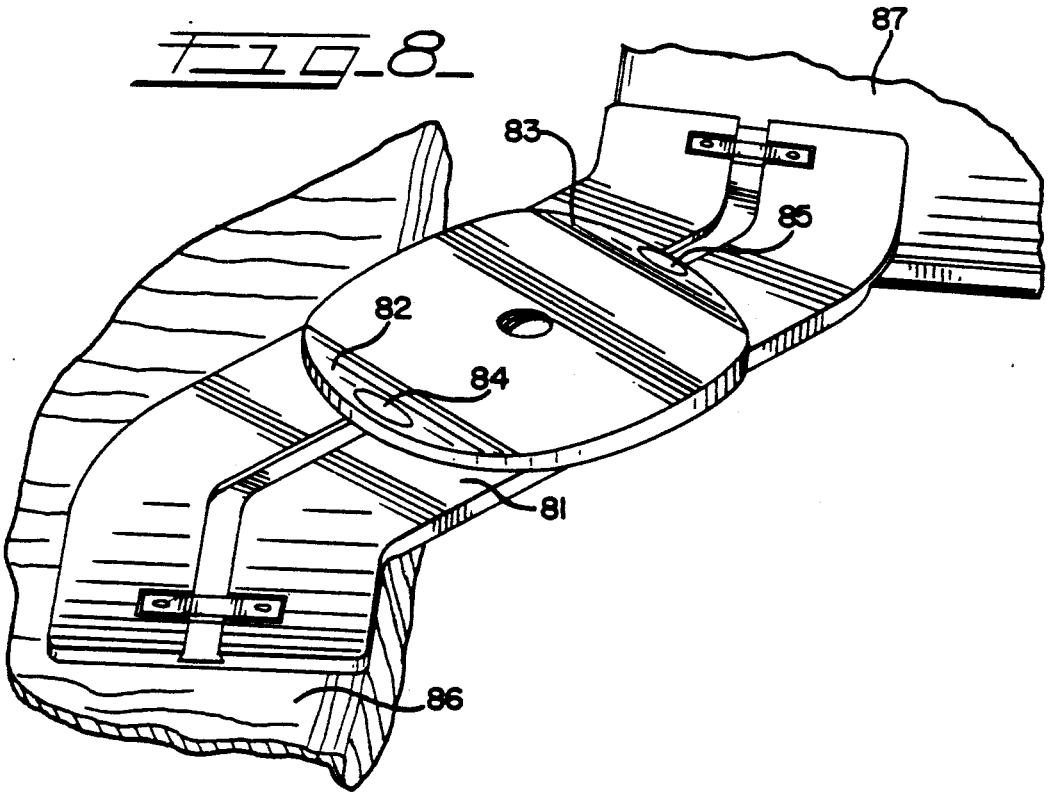
FIG. 8 illustrates a sliding transfer device of the present invention comprising a lower support plate having curves at both ends and a slidable seat having flexible handle flaps.

Preferably the lower support plate comprises a long radius arc. However, any arc, or combination of arcs, which would assist in turning the patient into a sitting position may be employed. Furthermore, the curvature on the top surface may be different at different points in the lower support plate. Thus, the curved lower support plate may contain a long radius arc at one end and a short radius arc at the other end. In this manner, the patient would be assisted even further by a sharper turn by the seat plate at the wheelchair seat end. Alternatively, the curved lower support can contain two equal arcs can be at opposite ends as shown in FIGS. 7 or 8.

Figure 3:
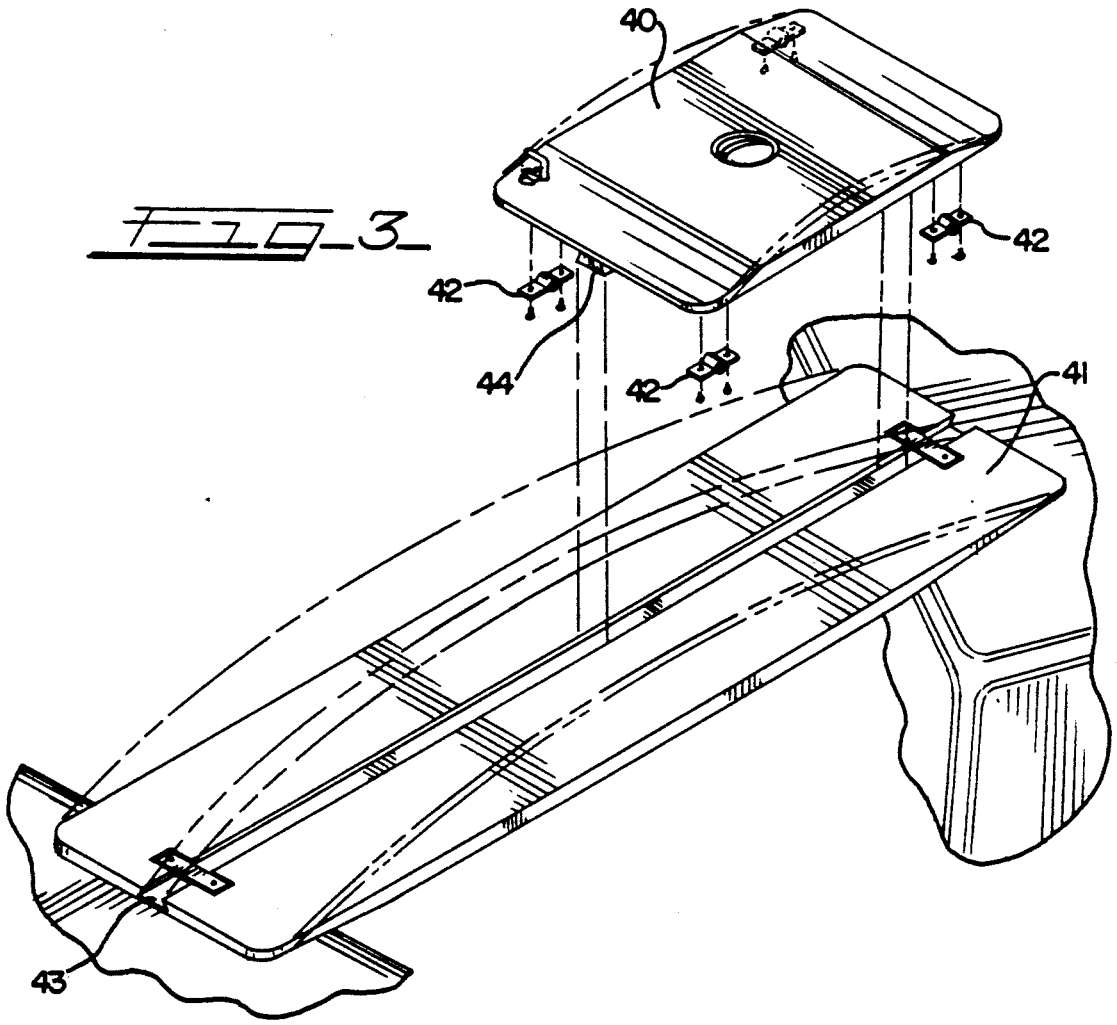
FIG. 3 illustrates an exploded view of a sliding transfer device of the present invention comprising either a substantially rectangular or curved lower support plate.

FIG. 3 is an exploded view of a sliding transfer device of the present invention. In this embodiment, upper seat 40 slidably fits into lower support plate 41 by guide 44 and track 43. Roller wheels 42 may be attached to the bottom of seat 40 to reduce the friction between the seat and the lower support plate. Other means for reducing friction between the upper seat and the lower support plate are contemplated. For example, the recessed guide track may be fitted with inside bearings, or the guide attached to the lower portion of the upper seat may be fitted with outside bearings. Also, a single ball bearing of suitable size may be placed at the bottom of the guide to further reduce friction.

The lower support plate and the upper seat may be constructed of any suitable material, including woods, metals such as stainless steel and aluminum, plastics such as nylon or fiberglass, or combinations of these materials. Also, handles may be provided to assist handling of the lower support plate and sliding transfer device.

The seat may be any appropriate shape. Thus, the seat may be cupped in the middle, but flared downwardly at the edges. This configuration will assist the patient to slide onto the device, and prevent clothing or parts of the body from becoming entangled as the seat slides across the lower support plate. The seat may also contain flaps, on one or more ends, that may be flexible, or raised, to further protect the patient's clothing or body parts. Handles may be incorporated into the flexible flaps as shown in FIG. 8.

The seat may be attached to the lower support plate by any suitable means. Preferably, the seat is attached by a guide and track arrangement whereby the seat slides across the length of the top surface of the lower support plate. Other sliding mechanisms known to those skilled in the art, however, are also contemplated. Such mechanisms would include, for example, rails, shoulders, rollers, and combinations thereof. Thus, the track may be set into the lower support plate, as presently preferred, or extend above the lower support plate.

Figure 5:
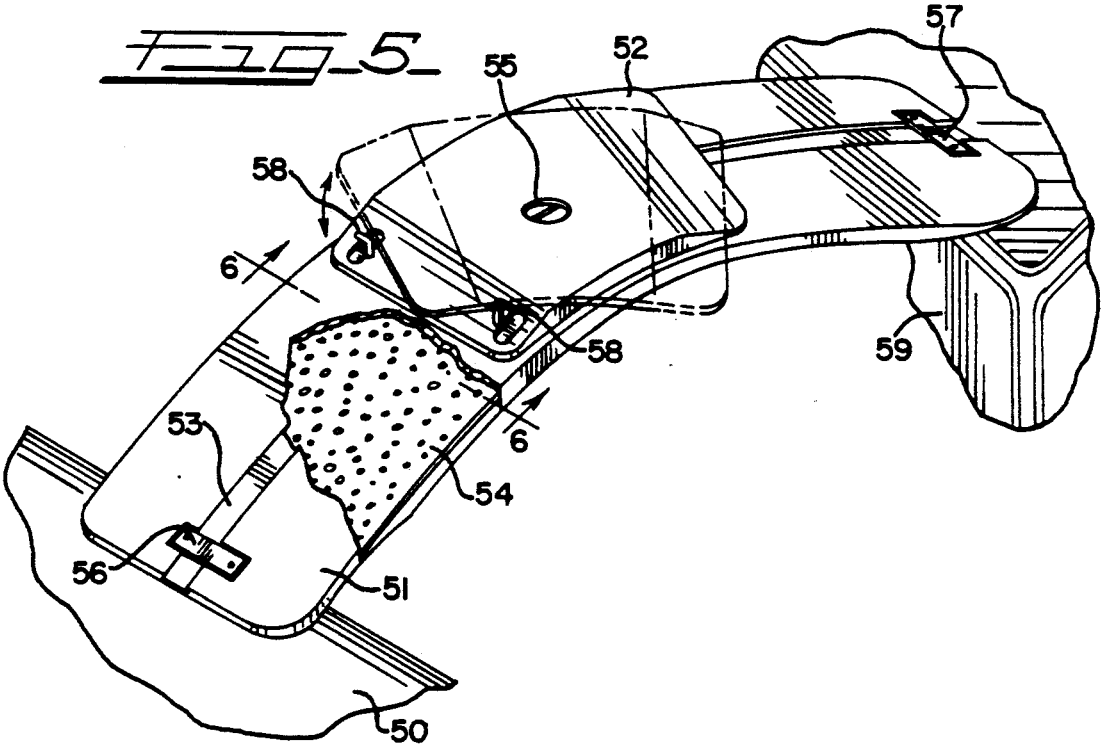
FIG. 5 illustrates a sliding transfer device of the present invention comprising a swivel upper seat.

FIG. 5 illustrates the swivel seat embodiment of the present invention, which comprises an upper seat 52 pivotally attached to a lower support plate 51 by swivel joint 55. The swivel enhances transfer of the patient because it allows either the upper seat or the lower support plate to pivot freely as the patient is moved on and off of the upper seat. Thus, the seat can be moved more easily under the patient because both the seat and the support plate can be maneuvered. After the patient is transferred, the swivel allows the upper seat to turn the patient. For example, if the patient is to be transferred from bed 59 to wheelchair seat 60, the swivel joint 55 allows the upper seat to be easily moved under the patient by pivoting either the lower support plate 51, the upper seat 52, or a combination of both. When the patient is transferred, the swivel joint 55 allows the upper seat 52 to turn and orient the patient's back toward the wheelchair seat back (not shown), and allows the patient to be easily moved off the upper seat. Means for controlling the range and rotation speed of the seat about the support plate 51, as well as the movement of the seat across the lower support plate 51 may also be employed.

The lower support plate 51 in this embodiment may be any of the shapes contemplated here, including rectangular, curved, or any such combination, and the upper seat is shaped accordingly. Moreover, track 53 is shown as a female recess to accept swivel joint 55, but any track arrangement which will accept a swivel joint may be used.

Figure 6:
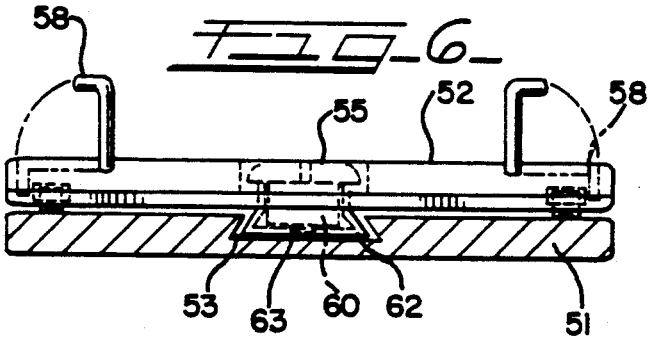
FIG. 6 illustrates a section view of FIG. 5.

Any swivel mechanism known in the art may be used. FIG. 6 illustrates one such mechanism where swivel joint 55 comprises a pin 60 and a wedge-shaped housing 62. The pin 60 sets into and is pivotally attached to the housing 62 by rivet 63. Locking devices 58, and lock plates 56 and 57, may also be used to enhance patient safety and control of the upper swivel seat 52. Thus, the swivel mechanism may be adaptable for a track set into or extending beyond the lower support plate.

FIG. 7 illustrates an additional embodiment of the sliding transfer device in which the lower support plate 71 has curved portions 72, 73 at either end to form a partial S-shape. The S-shape can be forward or backward, and is intended to encompass any shape in which the terminal ends of the support plate are curved in arcs of opposite direction to one another. The center portion 74 of the support plate 71 may be substantially rectangular, or may also be curved in any direction. A track 75 is fixed within, and in accordance with the shape of the lower support plate 71. The features already described, such as lock plates 76, 77, are also contemplated. The support plate may laid across the two transfer locations, such as the edge of a bed 78 and a wheelchair 79, and is operated in the manner already described.

FIG. 8 illustrates an additional seat embodiment of the present invention mounted upon the sliding lower support plate shown in FIG. 7. The upper seat 80 contains flaps 82, 83 located at opposite ends of the seat 80. The flaps may flexible or jointed so that they may be raised and lowered as needed. The flaps may also contain handle holes 84, 85. The flexible flaps assist placing the seat under the patient, and protect the patient against entangling clothing or body parts between the upper seat and the lower support plate as the patient is transferred from a bed 86 to a wheelchair 87. The upper seat of FIG. 8 may be employed with any of the lower support plate embodiments, and may be mounted in any of the ways already discussed. One preferable embodiment is to mount the upper seat 80 onto the lower support plate 81 with a swivel joint mechanism of the type described in FIG. 6.

The invention comprises additional embodiments such as a belt of approximately 20 to 30 inches may be provided to hold the patient on the seat. Furthermore, handles may be provided at appropriate locations on the seat and the lower support plate to provide balance and safety for the patient. Finally, the lower support plate may be formed around a support frame such as a perforated metal frame 54 shown in FIG. 5. In this embodiment, plastic or a similar material encases the frame which adds strength to the device without adding significant weight.

Also any means for aiding in sliding the upper seat across the lower support plate is contemplated. While the bearing arrangements under the seat and in the track already contemplated will reduce friction and assist movement of the seat, additional assistance may be required. Furthermore, the patient may have to transfer alone, and a power aid would reduce the effort required.

One such power aid comprises a small electrical motor, which may be battery operated and rechargeable. The motor is inserted in the support guide to provide or assist in the power needed to slide the upper seat from end to end of the lower support plate. Thus, a small gear near the bottom of the plate can be provided to mesh with a strip containing teeth and placed along the inside of the track. The seat moves across the support plate as the motor turns the gear. Additional known power aids, such as those employing various spring arrangements, are also contemplated.

I claim:

1. A portable sliding transfer device comprising a seat that is adapted to support a human user for movement between one body support, such as a bed, to another body support, such as a wheelchair, said device comprising:

a) a lower support plate having a substantially flat top surface, and ends adapted to be removably positioned proximate and in contact with said body supports, and b) an upper seat which is attached to the lower support plate such that the upper seat is slidable over the top surface of the lower support plate and the upper seat is pivotable with respect to the top surface of the lower support plate.

2. The sliding transfer device of claim 1 wherein the lower support plate comprises a recessed track in the top surface, and the upper seat comprises a guide affixed to the bottom portion of the seat, said guide slidably fitting into the recessed track.

3. The sliding transfer device of claim 1 wherein the upper seat comprises means for reducing the friction between the upper seat and the lower support plate.

4. The sliding transfer device of claim 1 wherein the lower support plate comprises means for reducing the friction between the upper seat and the lower support plate.

5. The sliding transfer device of claim 1 wherein the top surface of the lower support plate is substantially rectangular, and the upper seat is slidable over the length of the top surface.

6. The sliding transfer device of claim 1 wherein the top surface of the lower support plate is curve-shaped, and the upper seat is slidable over the path of the curve.

7. The sliding transfer device of claim 6 wherein the top surface of the lower support plate comprises more than one curvature.

8. The sliding transfer device of claim 1 wherein the top surface of the lower support plate is S-shaped.

9. The sliding transfer device of claim 1 wherein the upper seat and the lower support plate are attached by a swivel joint.

10. The sliding transfer device of claim 1 wherein the upper seat comprises a flexible flap at one or more ends.

11. The sliding transfer device of claim 1 wherein the upper seat comprises a flexible flap at one or more ends, said flexible flap containing handles.

12. A portable sliding transfer device comprising a seat that is adapted to support a human user for movement between one body support, such as a bed, to another body support, such as a wheelchair, said device comprising:

a) a curved lower support plate having a substantially flat top surface and ends adapted to be removably positioned proximate and in contact with said body supports, and b) an upper seat which is attached to the lower support plate such that the upper seat is slidable over the top surface of the lower support plate and the upper seat is pivotable with respect to the top surface of the lower support plate.

13. The sliding transfer device of claim 12 wherein the top surface of the lower plate comprises more than one curvature.

14. The sliding transfer device of claim 12 wherein the top surface of the lower support plate is S-shaped.

15. The sliding transfer device of claim 12 wherein the upper seat and the lower support plate are attached by a swivel joint.

16. The sliding transfer device of claim 12 wherein the upper seat comprises a flexible flap at one or more ends.

17. A portable sliding transfer device comprising a seat that is adapted to support a human user for movement between one body support, such as a bed, to another body support, such as a wheelchair, said device comprising:

a) an S-shaped lower support plate having a substantially flat top surface and ends adapted to be removably positioned proximate and in contact with said body supports, b) a track attached to the top surface, c) an upper seat, and d) a swivel joint affixed to the bottom portion of the upper seat, said joint slidably attached to the track thereby attaching the upper seat to the lower support plate so that the upper seat is slidable and pivotable over the top surface of the lower support plate.

* * * * *